United States Patent [19]

Stahl et al.

[11] 4,058,355

[45] Nov. 15, 1977

[54] TELEPRINTER CONSOLE

[75] Inventors: Horst Stahl, Weidach; Franz Thorand, Munich, both of Germany

[73] Assignee: Siemens Aktiengesellschaft, Berlin & Munich, Germany

[21] Appl. No.: 577,939

[22] Filed: May 15, 1975

[51] Int. Cl.[2] ..... A47B 85/00

[52] U.S. Cl. ..... 312/241; 312/22; 312/237; 312/244; 248/460

[58] Field of Search ..... 312/21, 22, 241, 244, 312/250, 313, 314, 233, 237; 248/441 B, 460

[56] References Cited

U.S. PATENT DOCUMENTS

| | | | |
|---|---|---|---|
| 721,860 | 3/1903 | Carr | 312/244 |
| 747,581 | 12/1903 | Boule | 312/196 |
| 917,161 | 4/1909 | Schultze | 312/22 |
| 1,526,672 | 2/1925 | Lockerbie | 312/22 |
| 1,652,895 | 12/1927 | Hedglon | 312/22 |
| 1,938,237 | 12/1933 | Wagenhorst | 312/22 |
| 2,297,995 | 10/1942 | Wise | 312/22 |
| 2,672,921 | 3/1954 | Herrick | 312/241 |
| 2,810,617 | 10/1957 | Slanhoff | 312/241 |
| 2,841,410 | 7/1958 | Kessler et al. | 312/250 |
| 3,201,186 | 8/1965 | Noonan et al. | 312/241 |
| 3,695,138 | 10/1972 | Andersen | 312/237 |
| 3,756,680 | 9/1973 | Lerner | 312/237 |

*Primary Examiner*—Paul R. Gilliam
*Assistant Examiner*—Victor N. Sakran
*Attorney, Agent, or Firm*—Hill, Gross, Simpson, Van Santen, Steadman, Chiara & Simpson

[57] ABSTRACT

A console for apparatus such as teleprinters including a box-like base or housing for housing the apparatus, a plate which is hinged to one side of the base and arranged to serve as a cover member in the housed condition of the apparatus and as a supporting surface in the ready for use condition of the apparatus, and bracket structures attached to the base which include upper and lower supporting portions.

4 Claims, 5 Drawing Figures

TELEPRINTER CONSOLE

BACKGROUND OF THE INVENTION

The present invention relates to consoles for apparatus such as teleprinters and data printers.

In the case of mobile teleprinters or data printers, such as those used in outside broadcasting vehicles for example, a major problem is presented by the casing used to protect the printer equipment against excessively heavy shocks during transportation. Moreover, a stable console must be made available for the printer equipment at its place of use. It is known in the case of teleprinters to use stable casings for transportation purposes, but these casings have to be removed at the place at which the teleprinter is to be set up and used. As will be readily understood, when removed, these casings constitute considerable obstacles, especially in confined spaces. Consequently, in order to set up the equipment, special consoles are necessary, which involves extra monetary outlay.

SUMMARY OF THE INVENTION

It is an object of the present invention to provide a teleprinter or data printer console which can be readily converted into a casing for transportation purposes and which is also suitable for installation suspended from a wall.

It is another object of the present invention to provide a teleprinter or data printer console which includes bracket means which may be used alternatively as a support for the console in a ready-for-use position and as a transportation aid when the equipment is to be moved.

Other objects and advantages of the invention will become more apparent when considering the following description and accompanying drawings.

DESCRIPTION OF PREFERRED EMBODIMENTS

The invention herein comprises a console for apparatus such as teleprinters and data printers including a box-like base or housing which is arranged to house said apparatus, and a plate which is hinged to one side of said base and which is arranged to serve as a cover member in the housed condition of the apparatus and as an apparatus supporting surface in the ready-for-use condition of said apparatus.

Such a console has the major advantage that it can be readily converted into a casing or crate, so that the complete printer station can be rapidly shifted from one location to another. In its collapsed condition, the console can be stacked very easily and, furthermore, paper rolls, inking ribbons, tools or other accessories can be accommodated inside the console. The installation of a teleprinter by securing it to the plate increases its operational reliability, economy and mobility to a considerable extent, because at each site of operations the same console is available and there is no need to have recourse to temporary expedients. Furthermore, when shifting from one location to another, the teleprinter can simply be folded down into the base.

In a particularly advantageous embodiment of the invention, the hinge pivot for the plate can be guided inside the box-like base, by guide rails, in a direction parallel to a side face of the said base, so that the plate can be pushed into the base parallel to said side face to bear against said side face.

In this way it is possible to arrange for the console, and therefore the printer station, to be suspended from a wall, thus facilitating its use inside such vehicles as on-site vans or outside broadcast vans, for example.

The box may be provided with two bracket structures having a stirrup-shaped portion located adjacent the base of the box and capable of being pivoted to form support feet for said box. Also, the box may be recessed adjacent the bracket structures, thereby enabling the brackets to serve as handles. By the provision of the two supporting brackets, the console is rendered particularly stable when set up, and since the brackets also form handles, the console as a whole can be readily carried and stacked.

Figure 1:
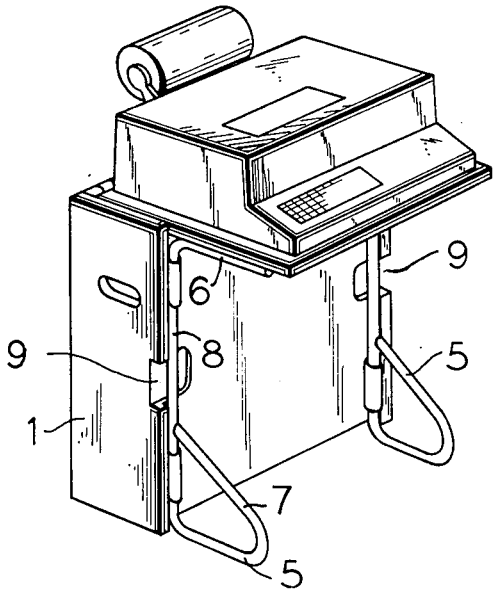
FIG. 1 is a front perspective view showing a teleprinter mounted on a console in a ready to use position and embodying the invention herein.
Figure 2:
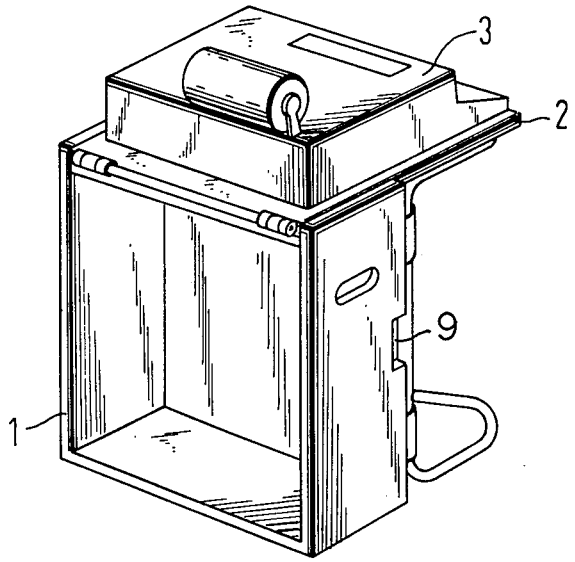
FIG. 2 is a rear perspective view of the teleprinter unit and console of FIG. 1.

In FIGS. 1 and 2 there is shown in perspective a console which is used in conjunction with a teleprinter. The console comprises a box-like base or housing 1, to which a plate 2 is hinged, said plate serving as a support surface for a teleprinter 3 and as a cover. The teleprinter 3 is attached to the plate 2 and can be pivoted into the box-like base 1 for transportation purposes, in which base the printer is protected against vibration, moisture and dirt. When the printer is to be used, the plate 2, with the teleprinter 3 attached thereto, is swung out and brought to rest against the upper portion of the two bracket structures 5 and a sidewall of box-like base 1. Each of the bracket structures 5 comprise an elongated rod-like member which may be bent into a shape to include an upper support portion 6, a lower stirrup-like portion 7 and an intermediate portion 8 interconnecting the upper and lower portions. The bracket structures 5 are pivotally attached to the face of the base 1 preferably near the edges thereof and adjacent the user and extend along the full height of the base 1. The stirrup-like lower portions 7 serve as feet to increase the stability of the console. Beneath the intermediate portions 8 of the brackets 5 joining the upper and lower portions thereof, hand holes 9 are formed in the base 1, thereby to provide handles by which the base 1 with the printer contained therein can be carried. As will be readily perceived, when not in use, the printer can be housed in the base 1 with the support plate 2 serving as a cover member and the bracket structures 5 swung flat against the front surface of the base 1, to form a readily movable package.

Figure 3:
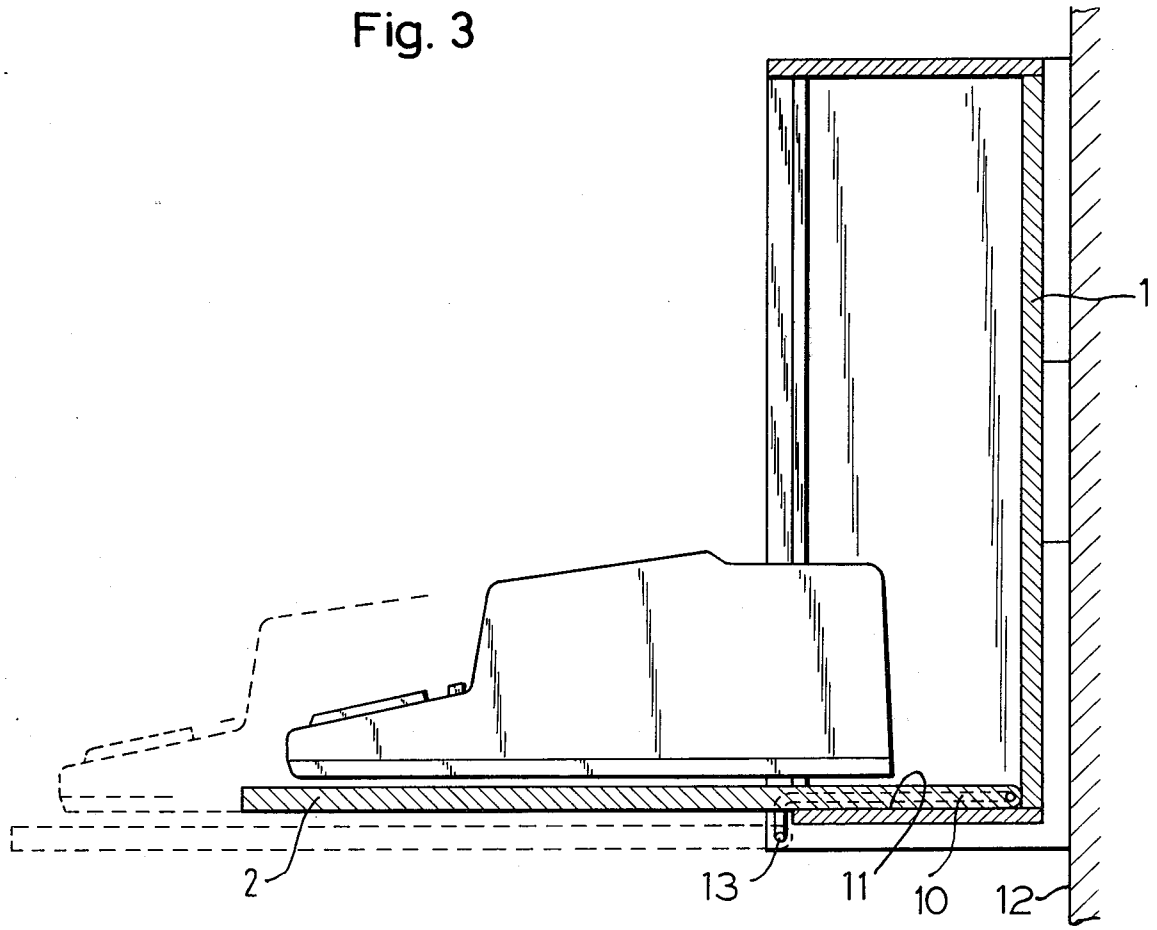
FIG. 3 is a side elevation view of a teleprinter unit mounted in a console embodying the invention herein, wherein the console is mounted on a wall.

FIG. 3 illustrates an embodiment of a console for fixing to a wall, for fixing in frames or for erection on a floor or some other supporting surface. In this embodiment, the plate 2 is guided between two guide rails 10 connected to the inner side of opposing side walls of the base 1, and can be pulled out of the base along these rails. For printer operation, the plate 2 is pushed into the base (shown in the figure in full lines) along the guide rails 10, and in this condition the front part of the plate 2 rests upon the internal face 11 of the base 1 so that it is positioned in a stable manner. The overall console is attached to the wall 12 by its rear face by suitable means (not shown). For transportation, the plate 2, with the teleprinter in position on it, is pulled out of the base along the guide rails 10 until it has reached the position shown in the dashed line, and is then swung up about the hinge 13. The plate 2 then forms the cover of the crate or casing, to complete said crate. If the console is not to be attached to the wall in the manner illustrated, but is to be erected in a standing position, then the plate 2 is pivoted through 180° when it has been pulled out, as described in FIGS. 1 and 2.

Figure 4:
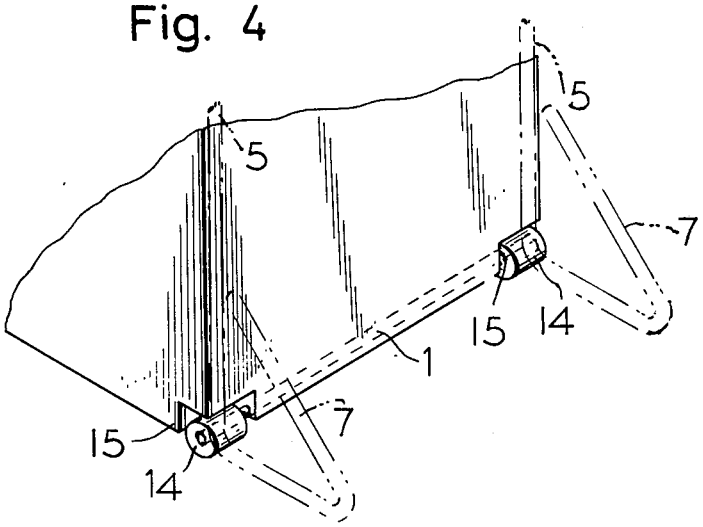
FIG. 4 is a partial view in perspective of a console equipped with transporting rollers at one edge thereof.

As shown in FIG. 4 the box-like base 1 may also be equipped with rollers 14 attached to the lower edge thereof in recesses 15 adjacent the lower stirrup-like portions 7 of the brackets 5. This further facilitates moving the console and its contents requiring only a tilting thereof.

Figure 5:
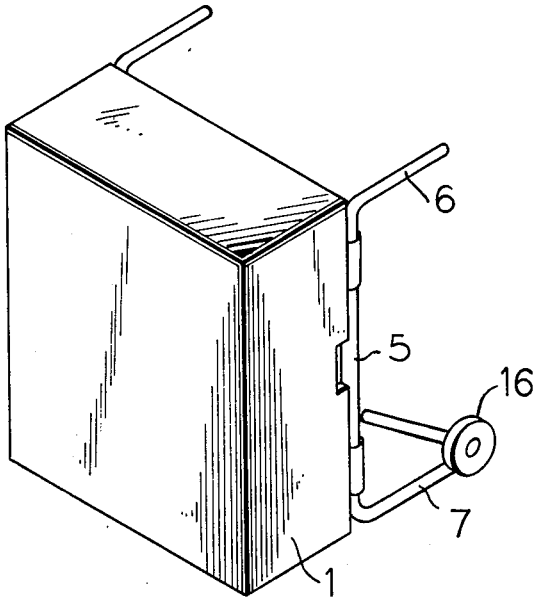
FIG. 5 is a perspective view of a console of the type shown in FIG. 1 wherein the support bracket is equipped with transporting rollers.

As shown in FIG. 5 in an alternative arrangement, rollers 16 may be attached to the lower stirrup-like portions 7 of the brackets 5. In this arrangement the additional advantage is provided that the brackets 5 may be used as handles during the moving of the console.

It will be appreciated that we have advantageously provided a console arrangement for teleprinters, data-printers and the like which can be used both as container for the equipment when the latter is to be moved and as a support when the equipment is being used.

While preferred embodiments of the invention have been disclosed, it will be appreciated that these have been shown by way of example only, and the invention is not to be limited thereto as other variations will be apparent to those skilled in the art and the invention is to be given its fullest possible interpretation within the terms of the following claims.

What is claimed is:

1. A portable console for storing and for setting up for use an apparatus, the console comprising:

a rectangular box having a one-piece first side;

a plate comprising a second side of said box adjacent said first side and normal thereto in a storage configuration of the box;

hinge means connecting said plate swivelably about an edge of said first side of the box in the storage position for movement of said plate from a storage position to a selected use position through an angle of one of 90° and 270°;

the second side of said box having a length normal to an axis of said hinge means which is greater than a length of said first side of the box normal to said axis, whereby the second side extends beyond the first side in the use position;

a third side of said box parallel and opposite to said second side in the storage configuration thereof and affixed in a position normal to said first side of said box;

at least one bracket member swivelably mounted to an outer side of said third side of said box, said bracket comprising a tubular support portion extending in a plane of said first side for supporting said plate in a set-up position thereof and for use as a handle for moving the console in the storage configuration thereof, and a lower portion adapted to brace against a ground support surface;

at least one guide rail mounted on an inside surface of said box parallel to said first side, each said rail extending normally to said hinge means axis; and said hinge means being movable along said rail for carrying said edge of said plate into said box and adjacent said third side of said box.

2. A portable console as defined in claim 1, wherein two of said brackets are provided, each said bracket extending along an opposite side edge of said third side of said box, and said third side being apertured about a central portion of each said brackets, whereby the brackets may be grasped for carrying said console.

3. A portable console as defined in claim 1, wherein an edge of said box diagonally opposite to said hinge means axis of the plate in the storage position has recessed portions therein and roller means fitted into said portions.

4. A portable console as defined in claim 1, wherein two of said brackets are provided, each further comprising a roller means fitted to each of said lower portions of said bracket, said roller means being engageable with a ground surface only when said console is tilted with respect to the vertical.

* * * * *